US007461544B2

(12) United States Patent
Kumar et al.

(10) Patent No.: US 7,461,544 B2
(45) Date of Patent: Dec. 9, 2008

(54) METHODS FOR DETECTING WATER INDUCTION IN STEAM TURBINES

(75) Inventors: Jitendra Kumar, Mableton, GA (US); Abhay S. Kant, Bangalore, IN (US); Vivek V. Badami, Schenectady, NY (US); Peter J Elsenzopf, Altamont, NY (US); Nicholas Giannakopoulos, Acworth, GA (US)

(73) Assignee: General Electric Company, Schenetady, NY (US)

( * ) Notice: Subject to any disclaimer, the term of this patent is extended or adjusted under 35 U.S.C. 154(b) by 415 days.

(21) Appl. No.: 11/307,822

(22) Filed: Feb. 24, 2006

(65) Prior Publication Data

US 2007/0204452 A1 Sep. 6, 2007

(51) Int. Cl.
*G01M 15/00* (2006.01)
*F01K 13/02* (2006.01)

(52) U.S. Cl. ..... 73/112.02; 60/660

(58) Field of Classification Search ..... 73/112; 60/646, 660, 662

See application file for complete search history.

(56) References Cited

U.S. PATENT DOCUMENTS 3,416,500 A * 12/1968 Lyons ..... 122/406.4
3,423,941 A * 1/1969 Evans ..... 60/658
3,496,724 A * 2/1970 Wilson ..... 60/646
4,087,797 A * 5/1978 Wyler ..... 340/626
4,322,267 A * 3/1982 Kinoshita et al. ..... 376/216
4,410,950 A * 10/1983 Toyoda et al. ..... 701/99
4,541,247 A * 9/1985 Martin ..... 60/660
4,995,257 A 2/1991 Leon
5,044,163 A * 9/1991 Bruckner et al. ..... 60/677
5,131,230 A 7/1992 Barton
5,412,936 A 5/1995 Lee
5,433,079 A * 7/1995 Badami et al. ..... 60/660
5,791,147 A 8/1998 Earley
5,794,446 A 8/1998 Earley
6,220,014 B1 * 4/2001 Wada et al. ..... 60/778
6,223,518 B1 * 5/2001 Wada et al. ..... 60/783
6,405,537 B1 * 6/2002 Wada et al. ..... 60/778
6,773,227 B2 8/2004 Montgomery
7,174,715 B2 * 2/2007 Armitage et al. ..... 60/646

(Continued)

FOREIGN PATENT DOCUMENTS

EP 0605156 A2 7/1994

(Continued)

*Primary Examiner*—Hezron Williams
*Assistant Examiner*—John Fitzgerald
(74) *Attorney, Agent, or Firm*—Sutherland Asbill & Brennan

(57) ABSTRACT

A method of detecting water induction in a steam turbine that may include the steps of: measuring the temperature of one of the steam lines of the steam turbine at regular intervals; recording the temperature measurements; and determining, from the recorded temperature measurements, whether there has been a sharp decrease followed by a gradual rise in the temperature of the steam line. The method further may include the steps of calculating the rate of change of the decrease in temperature of the steam line and the rate of change of the increase in temperature of the steam line. The sharp decrease followed by a gradual rise in the temperature of the steam line may include a decrease in temperature followed by an increase in temperature wherein the rate of change of the decrease in temperature exceeds the rate of change of the rise in temperature.

17 Claims, 2 Drawing Sheets

U.S. PATENT DOCUMENTS

| | | | |
|---|---|---|---|
| 2004/0136827 | A1 | 7/2004 | Montgomery |
| 2005/0016175 | A1 | 1/2005 | Barber |

FOREIGN PATENT DOCUMENTS

| | | | | |
|---|---|---|---|---|
| EP | 0605156 | B1 | | 9/1997 |
| EP | 1500792 | A2 | | 1/2005 |
| JP | 05125908 | | | 5/1993 |
| JP | 05125908 | A | * | 5/1993 |
| JP | 05321608 | | | 12/1993 |
| JP | 11148310 | | | 6/1999 |
| JP | 2001193417 | | | 7/2001 |
| JP | 2003193807 | | | 7/2003 |

* cited by examiner

METHODS FOR DETECTING WATER INDUCTION IN STEAM TURBINES

TECHNICAL FIELD

This present invention relates generally to methods and systems for detecting water induction in steam turbines.

BACKGROUND OF THE INVENTION

Water induction in steam turbines, which generally may be defined as water or cold steam in the steam lines, is a problem that affects the life and performance of the turbine. This anomaly is currently detected by low temperature measurements or abrupt changes in temperatures in the steam lines. These temperature readings generally are taken with thermocouples, which generally are installed in pairs in the upper and lower halves of the casing of a steam line at several points axially in outer shell. Under normal conditions, the lower and upper thermocouple will indicate approximately the same temperature. However, an abrupt decrease in temperature of the lower thermocouple while the upper thermocouple remains essentially unchanged or a significant drop in temperature measured in both thermocouples below a predetermined level may indicate the presence of water in the steam line.

In general, known systems rely on abrupt temperature differentials in the thermocouple pair to detect water induction. These systems indicate that water induction is occurring when the temperature differential between the upper and lower thermocouple exceeds a predetermined limit. However, fluctuations that occur during the normal operation of a steam turbine can cause such systems to show water induction occurring when it is not. As such, these known systems give a number of "false alarms." Over time, regularly occurring false alarms can cause real water induction events to be ignored, which can have a serious impact on the health of the turbine system. At a minimum, false alarms that force the system operator to confirm that water induction is not occurring waste time and resources. Thus, there is a need for improved methods and systems for reliably determining when water induction is occurring in steam turbines. Other objects, features and advantages of the invention will be found throughout the following description, drawings and claims.

SUMMARY OF THE INVENTION

The present application thus may describe a method of detecting water induction in a steam turbine, comprising the steps of: measuring the temperature of one of the steam lines of the steam turbine; and determining, from the measured temperatures, whether there has been a drop in temperature followed by a rise in temperature in the steam line. In some embodiments, the method further may include the step of determining whether the rate of change of the drop in temperature exceeded the rate of change of the subsequent rise in temperature. The method further may include the step of determining that water induction is probable if there has been a drop in temperature followed by a rise in temperature in the steam lines wherein the rate of change of the drop in temperature exceeded the rate of change of the rise in temperature. The method further may include the steps of: determining if the steam turbine is operating at approximately 20% of its maximum power output; and determining that water induction is not probable unless it is first determined that the steam turbine is operating at a minimum of approximately 20% of its maximum power output.

In other embodiments, the method may include the steps of: determining the temperature of the steam seal system of the steam turbine; and determining that water induction is probable if the temperature of the steam seal system drops below a predetermined temperature and remains below the predetermined level for a predetermined amount of time. The determining temperature of the steam system may include measuring the temperature at an outlet of the steam seal system pipe of a steam turbine auxiliary system. The predetermined temperature may be between approximately 200-300° F. (93 and 149° C.) and the predetermined amount of time may be approximately 10 seconds.

In other embodiments, the measuring temperature of one of the steam lines may include taking the temperature measurements at intervals between 0.5 and 2.5 seconds. The determination of whether there was a drop in temperature may include determining whether the temperature has fallen at least a predetermined amount for each of a predetermined number of consecutive falling temperature measurement periods. The predetermined amount may be approximately 3° F. (1.7° C.) and the predetermined number of consecutive falling temperature measurement periods may be 6.

In other embodiments, the determination of whether there is a drop in temperature may include determining whether the temperature has fallen for at least a predetermined number of consecutive falling temperature measurement periods. The determination of whether there is a rise in temperature may include determining whether the temperature has risen for at least a predetermined number of consecutive rising temperature measurement periods. The predetermined number of consecutive falling temperature measurement periods and the predetermined number of consecutive rising temperature measurement periods may be 6.

In other embodiments, the determining whether the rate of change of the drop in temperature exceeded the rate of change of the subsequent rise in temperature may include the steps of: calculating the average rate of change for the predetermined number of consecutive falling temperature measurements; calculating the average rate of change for the predetermined number of consecutive rising temperature measurements; and comparing the rate of change for the predetermined number of consecutive falling temperature measurements against the rate of change for the predetermined number of consecutive rising temperature measurements. The measuring the temperature of one of the steam lines may occur in the first stage bowl of the high pressure section, the exhaust bowl of the high pressure section, the first stage bowl of the intermediate pressure section, and/or the exhaust bowl of the intermediate pressure section.

The present application further may describe a method of detecting water induction in a steam turbine that may include the steps of: measuring the temperature of one of the steam lines of the steam turbine at regular intervals; recording the temperature measurements; and determining, from the recorded temperature measurements, whether there has been a sharp decrease followed by a gradual rise in the temperature of the steam line. Some embodiments of this method may include the steps of calculating the rate of change of the decrease in temperature of the steam line and the rate of change of the increase in temperature of the steam line. In such embodiments, the sharp decrease followed by a gradual rise in the temperature of the steam line may include a decrease in temperature followed by an increase in temperature wherein the rate of change of the decrease in temperature exceeds the rate of change of the rise in temperature.

In other embodiments, measuring the temperature of one of the steam lines may include taking the temperature measurements at intervals between 0.5 and 2.5 seconds. Determining whether there has been a sharp decrease in the temperature of the steam line may include determining whether there has been a decrease in temperature for a predetermined number of consecutive decreasing temperature measurements and determining whether there has been a gradual rise in the temperature of the steam line comprises determining whether there has been an increase in temperature for a predetermined number of consecutive rising temperature measurements. The sharp decrease in the temperature of the steam line may include a decrease in temperature such that the average rate of change during the predetermined number of consecutive decreasing temperature measurements exceeds a predetermined rate. The gradual rise in the temperature of the steam line may include a rise in temperature such that the average rate of change during the predetermined number of consecutive rising temperature measurements is less than a predetermined rate.

These and other features of the present invention will become apparent upon review of the following detailed description of the preferred embodiments when taken in conjunction with the drawings and the appended claims.

DETAILED DESCRIPTION OF EXEMPLARY EMBODIMENTS

Figure 1:
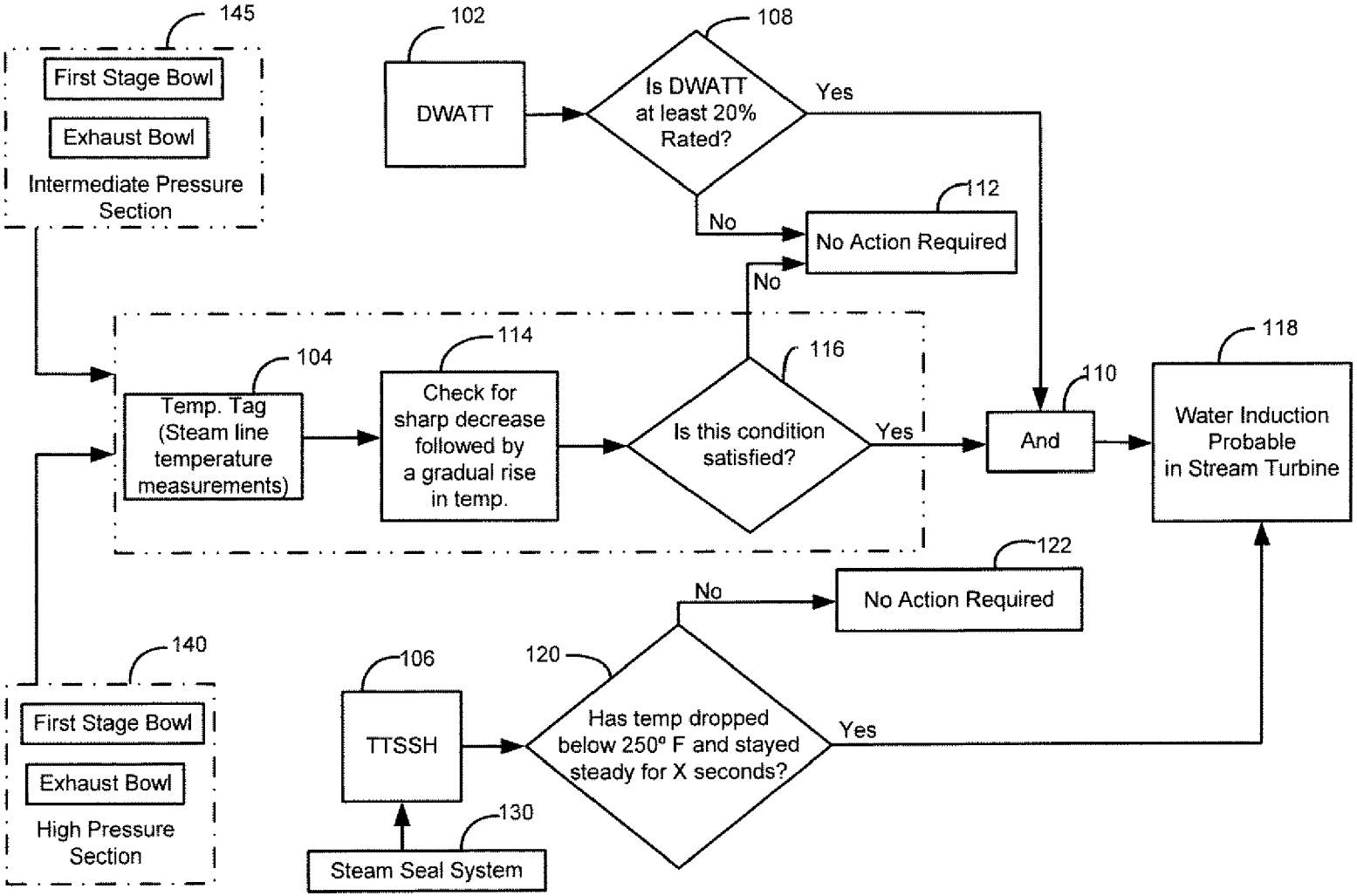
FIG. 1 is a flow diagram for an embodiment of an water induction detection algorithm according to the current invention.

Referring now to the figures, where the various numbers represent like parts throughout the several views, FIG. 1 shows an embodiment of the present invention, a data flow diagram 100, which may be used in a method or system to accurately predict the presence of water induction in the steam lines of a steam turbine. Data flow diagram 100 may contain three primary flows of data that are used to predict a water induction anomaly. In some embodiments, the data flow diagram 100 may be used while the steam turbine is operating in the following states: active turning gear, acceleration, speed hold, full speed no load, and/or loaded.

These main flows of data may include a DWATT data flow, which may begin at DWATT 102 and related to the power output of the steam turbine, a Temp. Tag data flow, which may begin at Temp. Tag 104 and relate to the temperature of the steam lines, and a TTSSH data flow, which may begin at TTSSH 106 and may related to the temperature of the steam seal system. Those of ordinary skill in the art will appreciate that the flow of data described herein may be modified somewhat or that fewer than all three of these data flows may be used without deviating from the inventive concept described herein. The use of all three data flows in FIG. 1 is an exemplary embodiment only. As described in more detail below, the process may be successfully used to determine water induction by using the Temp. Tag data flow only, the Temp. Tag data flow together with the DWATT data flow, the TTSSH data flow only, or all three of the data flows shown in FIG. 1.

The DWATT data flow may include a DWATT reading at a DWATT block 102. This reading may indicate the power output of the steam turbine and may be obtained from control systems and methods that are known in the art for controlling and operating steam turbine systems. Examples of known control and operating systems include turbine control and protection systems such as the Speedtronic™ Mark V™ and Mark VI™ systems. Once the DWATT reading is obtained the process may proceed to decision block 108 where a determination may be made as to whether the DWATT is at least 20% rated, i.e., whether the steam turbine is operating at 20% of its maximum power output. If this determination yields a "yes" result, the process may continue to AND block 110 (the operation of which will be described in more detail below). If the determination yields a "no" result, the process may continue to a NO ACTION REQUIRED block 112, where it is determined that water induction is not likely present in the steam turbine and, thus, no action is required. Those of ordinary skill will appreciate that the 20% level used above is exemplary only and that this level may be adjusted somewhat to a higher or lower value without deviating from the inventive concept described herein.

At the Tag Temp block 104 temperature readings from one or more locations in the steam turbine are obtained. These locations may include temperature readings from the steam lines of the first stage bowl of the high pressure section 140 of the steam turbine system. The temperatures taken in this location may reflect the metal temperature of the steam line and may be taken and recorded by devices, such as thermocouples, and other systems known in the art.

The temperature readings in the first stage bowl of the high pressure section 140 may be taken as a single measurement or in pairs. If taken as a single measurement, the temperature reading may record the metal temperature of the steam line within the high pressure section by measuring a single point on the steam line. If taken in pairs (as is common in the industry and in known systems used for the detection of water induction), the first measurement may record the metal temperature of the upper half of the steam line and the second measurement may record the metal temperature of the lower half of the steam line. The two measurements then may be averaged to obtain a metal temperature of the steam line at that specific point in the line. The single or averaged paired measurements may be taken at short intervals (such as every 0.5 to 2.5 seconds) and the readings may be recorded pursuant to methods known in the art such that the recorded temperature readings may be referenced and used in later calculations. This may be accomplished by using known control and operating systems for steam turbines, some of which are described above. Further, those of ordinary skill in the art will appreciate that multiple temperature locations within the first stage bowl of the high pressure section 140 may be employed by the inventive process described herein.

Temperature readings from other locations with the steam turbine also may be taken and recorded at Temp. Tag block 104. For example, temperature readings may be taken and recorded at the steam lines of the exhaust bowl of the high pressure section 140 of the steam turbine system. Similar to the temperatures taken above, these measurement also may be taken as a single measurement or in pairs as described above. The single or paired measurements may be taken at short intervals (such as every 0.5 to 2.5 seconds) and the readings may be recorded pursuant to methods known in the art such that the recorded temperature readings may be referenced and used in later calculations. Those of ordinary skill in the art will appreciate that multiple temperature locations within the exhaust bowl of the high pressure section 140 may be employed by the inventive process described herein.

At Temp. Tag block 104, temperature readings also may be taken and recorded at the steam lines of the first stage bowl of the intermediate pressure section 145. This measurement also may be taken as a single measurement or in pairs as described above. The single or paired measurements may be taken at short intervals (such as every 0.5 to 2.5 seconds) and the readings may be recorded pursuant to methods known in the art such that the recorded temperature readings may be referenced and used in later calculations. Those of ordinary skill in the art will appreciate that multiple temperature locations within the first stage bowl of the intermediate pressure section 145 may be employed by the inventive process described herein.

At Temp. Tag block 104, temperature readings also may be taken and recorded at the steam lines of the exhaust bowl of the intermediate pressure section 145 of the steam turbine system. Similar to the temperatures taken above, these measurement also may be taken as a single measurement or in pairs as described above. The single or paired measurements may be taken at short intervals (such as every 0.5 to 2.5 seconds) and the readings may be recorded pursuant to methods known in the art such that the recorded temperature readings may be referenced and used in later calculations, Those of ordinary skill in the art will appreciate that multiple temperature locations within the exhaust bowl of the intermediate pressure section may be employed by the inventive process described herein. Further, those of ordinary skill in the art will appreciate that other locations in other sections of the steam turbine may be used for the needed temperature measurements.

Figure 2:
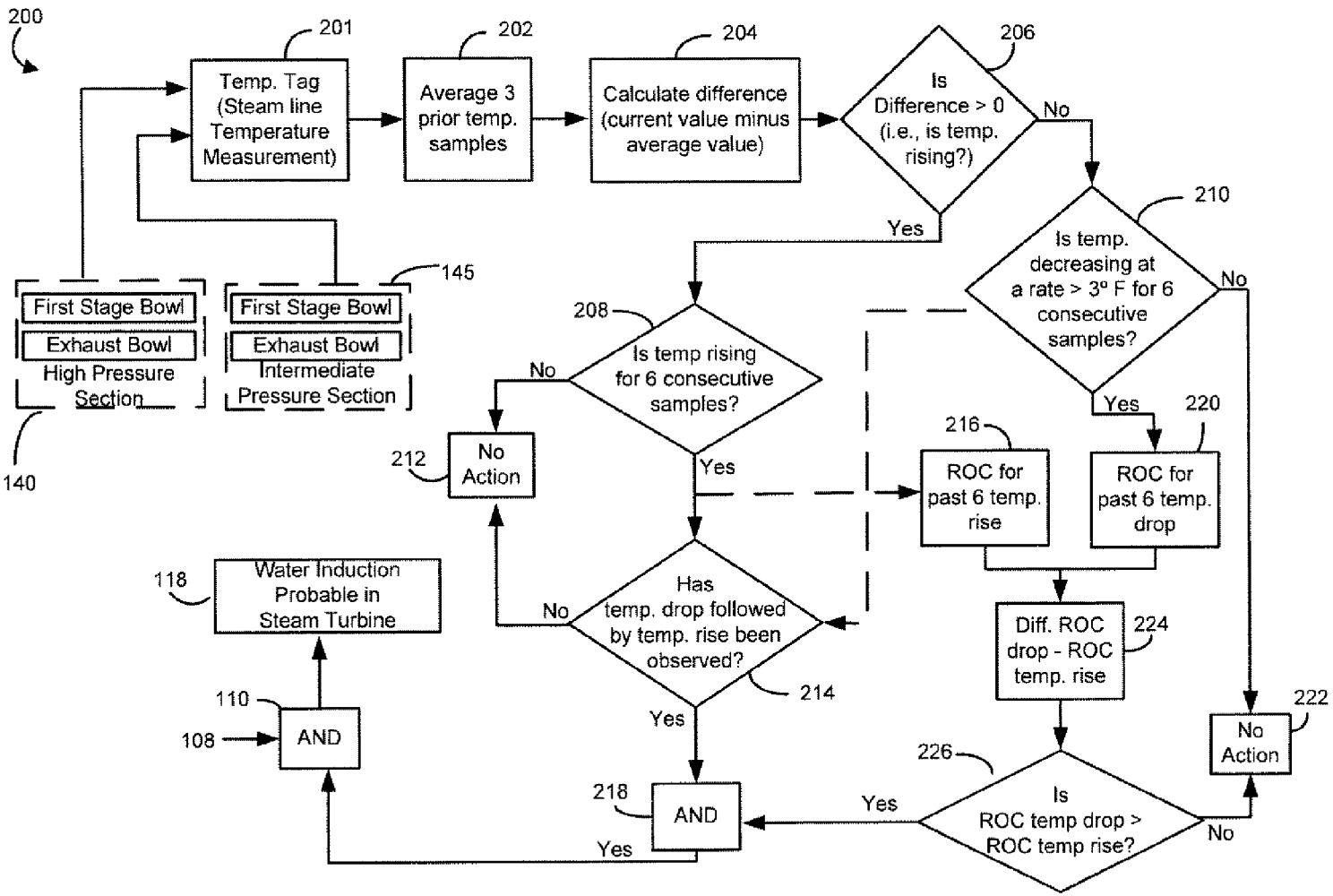
FIG. 2 is a more detailed flow diagram for a component of the flow diagram shown in FIG. 1.

At a block 114 the temperature measurements taken at block 104 may be analyzed together with the prior recorded temperature measurements so that, in general, the process may check for a sharp drop followed by a gradual rise in temperature. In some embodiments, this may be defined as a drop followed by a rise wherein the rate of change of the drop is greater than the rate of change for the rise. In other embodiments, the sharp temperature drop may be defined as a decreasing temperature rate that exceeds a predetermined rate. The gradual temperature rise may be defined as an increasing temperature rate that is less than a predetermined rate. Such a pattern, i.e., a sharp drop followed by a gradual rise in temperatures, may be indicative of a water induction anomaly in the steam turbine. A particular embodiment of this process (i.e., the process by which the method checks for a sharp drop followed by a gradual rise in temperatures) is described in more detail in the text associated with FIG. 2. Those of ordinary skill will appreciate that there are other methods for detecting this condition, some of which are described herein, and that the process described in FIG. 2 is exemplary only. At decision block 116, if the condition of block 114 is satisfied, the process may proceed to an AND block 110. If, however, the condition described in block 114 is found not to be present, the process may proceed from block 116 to the NO ACTION REQUIRED block 112, where it is determined that water induction is not likely present in the steam turbine and, thus, no action is required.

At the AND block 110, an "and" logic function may be performed on the inputs from block 108 and block 116. As such, if both the conditions from block 108 and block 116 are satisfied (i.e., both block 108 and block 116 yield a "yes" result) the process may continue to a block 118 where it is determined that water induction is probable in the steam turbine. Pursuant to methods known in the art, the system may then alert operators by an alarm, email, etc. that water induction in the steam turbine is likely and that remedial action should be taken. However, if one or both of the "yes" inputs from block 108 and block 116 are not present, the process will not continue to block 118. Instead, the process will continue to the NO ACTION REQUIRED block 112, where it is determined that water induction is not likely present in the steam turbine and, thus, no action is required.

The TTSSH data flow may include a TTSSH temperature reading at block 106. The TTSSH temperature reading may indicate the temperature of the steam seal system 130 of the steam turbine. This reading may be obtained by recording the temperature at the outlet of the steam seal system pipe of the steam turbine auxiliary system. This temperature measurement may be taken by devices, such as a thermocouple, and systems known in the art. The TTSSH reading at block 106 also may be recorded by control systems known in the art such that prior readings may be referenced and used in later calculations. At decision block 120, a determination may be made whether the TTSSH temperature has dropped below a predetermined level and remained generally steady for a predetermined amount of time. The predetermined temperature level may be approximately between 200 and 300° F. (93 and 149° C.), though this may be modified depending on different steam turbines applications and the pressure at which they operate, as this temperature generally is based upon the temperature at which the steam condenses within the steam turbine. As shown in FIG. 1, the predetermined temperature level may be 250°F. (121° C.).

The amount of time for which the temperature must remain generally steady at the decreased temperature measurement may be approximately 5 to 15 seconds, though this also may be modified depending on different applications. For some applications, the amount of time for which the temperature must remain generally steady may be approximately 10 seconds. If the conditions are satisfied in block 120, i.e., a "yes" response is obtained, the process may proceed to block 118 where it is determined that water induction is probable in the steam turbine. If a "no" result is obtained from the inquiry of block 108, the process will continue to a NO ACTION REQUIRED block 122, where it is determined that water induction is not likely present in the steam turbine and, thus, no action required.

FIG. 2 is a data flow diagram 200 that describes in more detail an embodiment of the Tag Temp data flow component of FIG. 1. The process may begin at a Tag Temp block 201, where the temperature reading from one of the above-described locations within the steam turbine is obtained. These temperature locations may include steam lines in the first stage bowl of the high pressure section 140, the exhaust bowl of the high pressure section 140, the first stage bowl of the intermediate pressure section 145, the exhaust bowl of the intermediate pressure section 145, or other locations. The process may determine at block 201 a current reading at one of the temperature locations, and data flow diagram 200 may represent the processing of this data as it is received from one of the temperature locations within the steam turbine according to an embodiment of the present invention.

Once the temperature reading has been obtained at block 201, the process may proceed to a block 202 where the average of the previously recorded samples may be calculated. In some embodiments, the previous three temperature measurements (i.e., temperature measurements taken and recorded prior to the current temperature measurement) may be averaged to arrive at an average temperature value. Those of ordinary skill will appreciate that more or less previous temperature measurements may be used to arrive at the average. Further, in some embodiments, the process may use only a single previous temperature measurement and, thus, bypass the averaging step.

At a block 204, the process may calculate the difference between the current temperature measurements and the average temperature value determined in block 202. Based on the difference calculated at block 204, the process may proceed to a block 206 to determine whether the temperature at the temperature location is rising (if the difference determined at block 204 is greater than 0) or falling (if the difference determined at block 204 is less than 0). If the temperature is determined to be rising, the process may proceed to a decision block 208. If the temperature is determined to be falling, the process may proceed to a decision block 210.

At decision block 210, the process may determine if the falling temperature readings are decreasing sharply, which, in some embodiments, may be defined as a rate greater than a predetermined rate. In some embodiments, the predetermined rate may be a rate greater than −3° F. between measurements. This calculation may be achieved, for example, by referring to the temperature differential calculated at block 204 and then determining whether the predetermined rate is exceeded for a certain number of consecutive samples. In some embodiments, 6 consecutive samples may be used. Thus, if decision block 210 determines that the difference between the current value and the average value is −3° F. (approximately −1.7° C.) for 6 consecutive samples, the process will determine that the temperature is decreasing sharply. Those of ordinary skill will recognize that a temperature differential of greater or less value may be used for the predetermined rate and that more or less consecutive samples may be required depending on the application. While the values provided herein may be effective for some applications, they are exemplary only.

If it determined at decision block 210 that the temperature measurements are decreasing rapidly, the process may proceed to block 220. If it is determined at decision block 210 that the temperature measurement is not decreasing sharply, the process may proceed to a block 222 where it is determined that water induction is not likely and no action is required. Further, at decision block 210, the data associated with the falling temperatures may be sent to decision block 214 such that the inquiry as to whether a temperature drop was followed by a temperature rise may be answered. This flow of data is represented by a dashed line in FIG. 2.

At decision block 208, a determination may be made as to whether the temperature is rising for consecutive samples periods. In some embodiments, the process may determine if the temperature is rising for 6 consecutive periods. In other embodiments, the process may determine whether the temperature has been rising for consecutive periods at a rate that is less than a predetermined rate, which may be used to define a gradual temperature rise. Thus, at block 208, as shown in FIG. 2, the process may look back at the recorded outcome from the calculations made at decision block 206 to determine if the temperature has been rising for 6 consecutive samples. (In other embodiments, not shown in FIG. 2, the process may analyze the previous temperature measurements and calculations to determine whether the rate at which the temperature increases is less than a pre-determined rate.) If it is determined at block 208 that the temperature has not been rising for 6 consecutive samples, the process may proceed to a block 212 where it is determined that water induction in the steam turbine is unlikely and that no action is required. If, however, it is determined at block 208 that the temperature has been rising for 6 consecutive samples, the process may proceed to a decision block 214. Further, the data associated with the rising temperature measurements and the calculations made in block 206 and 208 may be forwarded to a block 216 (as represented by a dashed line in FIG. 2) so that the rate of change of the rising temperatures may be determined, which will be discussed in more detail below. Those of ordinary skill will appreciate that the process may require more or less than 6 consecutive samples of rising temperatures. Further, a rule allowing for non-consecutive rising temperature readings may be used with success. Such a rule, for example, may required that the temperature be rising in 6 of the previous 7 temperature readings. A similar rate may be employed in association with the calculations made for decreasing temperatures in block 210.

At decision block 214, the process may determine whether the past temperature readings indicate that there has been a temperature drop followed by a temperature rise. This may be determined, for example, by determining whether the 6 consecutive rising temperature readings confirmed at block 208 where preceded by consecutive falling temperatures. The number of consecutive falling temperatures required may be approximately 6 in number, though this amount may vary with different applications. As represented by a dashed line in FIG. 2, the process may forward the information on falling temperatures from decision block 210 to block 214. If decision block 214 determines that there has been a temperature drop followed by a temperature rise, the process may continue to an AND block 218. If decision block 214 determines that there has not been a temperature drop followed by a temperature rise, the process may proceed to the block 212 where it is determined that no action is required.

At block 216, the rate of change for the consecutive rising temperature measurements may be calculated. This may be calculated by averaging the differential between each of the 6 consecutive temperature readings. The use of 6 consecutive samples is exemplary only, and a greater or less number of consecutive (or non-consecutive in some cases) temperature readings may be used. Similarly, at block 220, the rate of change may be calculated for the prior 6 consecutive falling temperature measurements. This may be determined by averaging the differential between each of the consecutive (or, as stated, non-consecutive in some cases) temperature measurements. The rate of change determinations from block 216 and block 220 then may be forwarded to a block 224 where the differential between the rate of change of the falling temperature measurements and the rate of change of the rising temperature measurements may be determined. This may be calculated by subtracting the rate of change of the rising temperatures from the rate of change of the falling temperatures.

At a decision block 226, the process may determine whether the rate of change of the falling temperature measurements is greater than the rate of change of the rising temperature measurements. This may be determined by determining if the calculation performed at block 224 yielded a positive or negative result. If the rate of change of the falling temperature measurements is greater than the rate of change of the rising temperature measurements, the process may proceed to the AND block 218 with a yes determination to the inquiry. If the rate of change of the falling temperature measurements is not greater than the rate of change of the rising temperature measurements, the process may proceed to block 222 where it may be determined that water induction is unlikely and no action is required.

At the AND block 218, an "and" logic function may be performed on the inputs from block 214 and block 226. Thus, if block 214 and block 226 both yield a "yes" determination, the process may continue to the AND block 110, that was previously described in relation to FIG. 1. If, however, either block 214 or block 226 or both yield a "no" result, the process will not continue past block 218.

At the AND block 110, the process may perform an "and" logic function on the inputs from block 108 and block 218. As state, the description above related to FIG. 2 is a more detailed description of the analysis represented in FIG. 1 by blocks 114 and 116. Accordingly, the output from block 218 represents the output of block 116 of FIG. 1. If both the conditions from block 108 and block 218 (or, referring to FIG. 1, block 116) are satisfied, the process may continue to a block 118 where it is determined that water induction is probable in the steam turbine. Pursuant to methods known in the art, the system may then alert operators by an alarm, email, etc. that water induction in the steam turbine is likely and that remedial action should be taken. However, if one or both of the "yes" inputs from block 108 and block 218 (or, referring to FIG. 1, block 116) are not present, the process will not continue to block 118 and no water induction will be indicated by the process.

The data flow of flow diagram 200 illustrates an exemplary method according to the present invention for detecting likely water induction based on temperature measurements at a single location within the steam turbine. This method may be performed using temperature data from several locations within the steam turbine, such as within the first stage bowl of the high pressure section 140, the exhaust bowl of the high pressure section 140, the first stage bowl of the intermediate pressure section 145, the exhaust bowl of the intermediate pressure section 145, or other locations. Applying the process to multiple temperature locations within the steam turbine may tend to increase the reliability and accuracy of the detecting the occurrences of water induction. However, under certain conditions, multiple temperature gathering locations may lead to conflicting results, i.e., one location may yield a positive result and another a negative result. These may be resolved by employing addition rule sets to determine when the process will indicate the occurrence of water induction. For example, the process may have a certain percentage of the temperature gathering locations report water induction before water induction is deemed probable by the process. In some embodiments, this percentage may be set at 50%, though this level may be adjusted. In certain other applications and depending on the desires of the system operators, a single determination of water induction at any of the temperature measurements locations may be deemed sufficient to find water induction likely and remedial action necessary.

The method described herein may be performed by devices and systems known in the art. The temperature measurements may be taken by thermocouples, or other similar devices. The recording of the temperature measurements and manipulation of the data may be performed by several software packages known in the art. As stated, such software packages are commonly used to control and operate steam turbine systems.

Therefore, the foregoing is considered as illustrative only of the principles of the invention. The features and aspects of the present invention have been described or depicted by way of example only and are therefore not intended to be interpreted as required or essential elements of the invention. It should be understood that the foregoing relates only to certain exemplary embodiments of the invention, and that numerous changes and additions may be made thereto without departing from the spirit and scope of the invention as defined by any appended claims.

What is claimed is:

1. A method of detecting water induction in a steam turbine, comprising the steps of:

measuring the temperature of one of the steam lines of the steam turbine;

determining, from the measured temperatures, whether there has been a drop in temperature followed by a rise in temperature in the steam line;

determining whether the rate of change of the drop in temperature exceeded the rate of change of the subsequent rise in temperature;

determining that water induction is probable if there has been a drop in temperature followed by a rise in temperature in the steam lines wherein the rate of change of the drop in temperature exceeded the rate of change of the rise in temperature;

determining if the steam turbine is operating at approximately 20% of its maximum power output; and determining that water induction is not probable unless it is first determined that the steam turbine is operating at a minimum of approximately 20% of its maximum power output.

2. The method of claim 1, wherein measuring the temperature of one of the steam lines comprises taking the temperature measurements at intervals between 0.5 and 2.5 seconds.

3. The method of claim 2, wherein the determination of whether there was a drop in temperature comprises determining whether the temperature has fallen at least a predetermined amount for each of a predetermined number of consecutive falling temperature measurement periods.

4. The method of claim 3, wherein the predetermined amount is approximately 3° F. (1.7° C.) and the predetermined number of consecutive falling temperature measurement periods is 6.

5. The method of claim 2, wherein the determination of whether there is a drop in temperature comprises determining whether the temperature has fallen for at least a predetermined number of consecutive falling temperature measurement periods.

6. The method of claim 5, wherein the determination of whether there is a rise in temperature comprises determining whether the temperature has risen for at least a predetermined number of consecutive rising temperature measurement periods.

7. The method of claim 6, wherein the predetermined number of consecutive falling temperature measurement periods and the predetermined number of consecutive rising temperature measurement periods is 6.

8. The method of claim 6, wherein the determining whether the rate of change of the drop in temperature exceeded the rate of change of the subsequent rise in temperature comprises the steps of:

calculating the average rate of change for the predetermined number of consecutive falling temperature measurements;

calculating the average rate of change for the predetermined number of consecutive rising temperature measurements; and comparing the rate of change for the predetermined number of consecutive falling temperature measurements against the rate of change for the predetermined number of consecutive rising temperature measurements.

9. A method of detecting water induction in a steam turbine, comprising the steps of:

measuring the temperature of one of the steam lines of the steam turbine;

determining, from the measured temperatures, whether there has been a drop in temperature followed by a rise in temperature in the steam line;

determining the temperature of the steam seal system of the steam turbine; and determining that water induction is probable if the temperature of the steam seal system drops below a predetermined temperature and remains below the predetermined level for a predetermined amount of time.

10. The method of claim 9, wherein the determining the temperature of the steam system comprises measuring the temperature at an outlet of the steam seal system pipe of a steam turbine auxiliary system.

11. The method of claim 9, wherein the predetermined temperature is between approximately 200-300° F. (93 and 149° C.) and the predetermined amount of time is approximately 10 seconds.

12. A method of detecting water induction in a steam turbine, comprising the steps of:

measuring the temperature of one of the steam lines of the steam turbine;

determining, from the measured temperatures, whether there has been a drop in temperature followed by a rise in temperature in the steam line, wherein the measuring the temperature of one of the steam lines occurs in the first stage bowl of the high pressure section, the exhaust bowl of the high pressure section, the first stage bowl of the intermediate pressure section, and/or the exhaust bowl of the intermediate pressure section; and determining whether the rate of change of the drop in temperature exceeded the rate of change of the subsequent rise in temperature.

13. A method of detecting water induction in a steam turbine, comprising the steps of:

measuring the temperature of one of the steam lines of the steam turbine at regular intervals;

measuring the temperature of the steam seal system of the steam turbine;

recording the temperature measurements;

determining, from the recorded temperature measurements, whether there has been a sharp decrease followed by a gradual rise in the temperature of the steam line;

determining, from the recorded temperature measurements, the temperature of the steam seal system of the steam turbine; and determining that water induction is probable if the recorded temperature of the steam seal system drops below a predetermined temperature and remains below the predetermined level for a predetermined amount of time.

14. The method of claim 13, further comprising the steps of calculating the rate of change of the decrease in temperature of the steam line and the rate of change of the increase in temperature of the steam line;

wherein, the sharp decrease followed by a gradual rise in the temperature of the steam line comprises a decrease in temperature followed by an increase in temperature wherein the rate of change of the decrease in temperature exceeds the rate of change of the rise in temperature.

15. The method of claim 13, wherein measuring the temperature of one of the steam lines comprises taking the temperature measurements at intervals between 0.5 and 2.5 seconds;

determining whether there has been a sharp decrease in the temperature of the steam line comprises determining whether there has been a decrease in temperature for a predetermined number of consecutive decreasing temperature measurements; and determining whether there has been a gradual rise in the temperature of the steam line comprises determining whether there has been an increase in temperature for a predetermined number of consecutive rising temperature measurements.

16. The method of claim 15, wherein the sharp decrease in the temperature of the steam line comprises a decrease in temperature such that the average rate of change during the predetermined number of consecutive decreasing temperature measurements exceeds a predetermined rate.

17. The method of claim 15, wherein the gradual rise in the temperature of the steam line comprises a rise in temperature such that the average rate of change during the predetermined number of consecutive rising temperature measurements is less than a predetermined rate.

* * * * *